US010769885B2

(12) United States Patent
Hoehne

(10) Patent No.: US 10,769,885 B2
(45) Date of Patent: Sep. 8, 2020

(54) SYSTEMS AND METHODS OF FACILITATING INTERACTIONS BETWEEN AN ELECTRONIC GAMING MACHINE, GAME PLAYER, AND A CONTROL SYSTEM

(71) Applicant: Table Trac, Inc., Minnetonka, MN (US)

(72) Inventor: Chad B. Hoehne, Minnetonka, MN (US)

(73) Assignee: TABLE TRAC, INC., Minnetonka, MN (US)

( * ) Notice: Subject to any disclaimer, the term of this patent is extended or adjusted under 35 U.S.C. 154(b) by 44 days.

(21) Appl. No.: 15/946,227

(22) Filed: Apr. 5, 2018

(65) Prior Publication Data

US 2018/0293837 A1 Oct. 11, 2018

Related U.S. Application Data

(60) Provisional application No. 62/481,747, filed on Apr. 5, 2017.

(51) Int. Cl.
*G07F 17/32* (2006.01)
*G07F 17/34* (2006.01)

(52) U.S. Cl.
CPC ..... *G07F 17/3223* (2013.01); *G07F 17/3206* (2013.01); *G07F 17/329* (2013.01); *G07F 17/3211* (2013.01); *G07F 17/3227* (2013.01); *G07F 17/3244* (2013.01); *G07F 17/3293* (2013.01); *G07F 17/34* (2013.01)

(58) Field of Classification Search
CPC ..... G07F 17/32
See application file for complete search history.

(56) References Cited

U.S. PATENT DOCUMENTS 8,645,685 B2 2/2014 Nguyen et al.
9,552,693 B1 1/2017 Reeves
2008/0026844 A1* 1/2008 Wells ..... G07F 17/3206 463/39
2012/0046096 A1 2/2012 Morrison et al.
(Continued)

FOREIGN PATENT DOCUMENTS

WO 03002222 A1 1/2003

OTHER PUBLICATIONS

International Search Report and Written Opinion issued for International Patent Application No. PCT/US2018/026234, dated Jul. 25, 2018, 13 pages.

*Primary Examiner* — Reginald A Renwick
(74) *Attorney, Agent, or Firm* — Hamre, Schumann, Mueller & Larson, P.C.

(57) ABSTRACT

Interactions between a player, an electronic gaming machine being played by the player, and a control system that is interfaced with both the electronic gaming machine and the player's smart device are described. The player registers with the electronic gaming machine and also registers with the control system using an application residing on the player's smart device which establishes the player's identity and physical location as being within the venue containing the electronic gaming machine and/or near the electronic gaming machine. In one embodiment, when both registrations are active, a control command can be sent from the player's smart device that controls an operation of the electronic gaming machine.

6 Claims, 10 Drawing Sheets

(56) References Cited

U.S. PATENT DOCUMENTS

| | | | | |
|---|---|---|---|---|
| 2013/0273996 | A1* | 10/2013 | Froy, Jr. ..... | G07F 17/3239 463/20 |
| 2015/0187177 | A1 | 7/2015 | Warner et al. | |
| 2015/0228153 | A1* | 8/2015 | Hedrick ..... | G06Q 20/3223 463/25 |

* cited by examiner

SYSTEMS AND METHODS OF FACILITATING INTERACTIONS BETWEEN AN ELECTRONIC GAMING MACHINE, GAME PLAYER, AND A CONTROL SYSTEM

FIELD

The technology described herein relates to gaming in casinos and other venues containing electronic gaming machines, and facilitating interactions between a game player, an electronic gaming machine being played by the player, and a control system that is interfaced with both the electronic gaming machine and a smart device, defined later in the description, carried or worn by, or implanted in, the game player. The technology described herein also relates to facilitating interactions between a user and other machines via the user's smart device.

BACKGROUND

Most casinos implement rewards programs for their customers. The rewards programs can vary in specific overall content but in general each rewards program involves tracking the amount of game play by the player, offering promotions, incentives and rewards to the player, and the like. Casino rewards programs typically issue a token such as card to each player that signs up for the rewards program. The token is used by the game player and the casino to keep track of the amount of game play by the player. The token can be used to track game play on any game found in a casino including table games such as blackjack or roulette, or gaming machines such as slot machines and video poker.

In one example involving electronic slot machines, a player intending to play a specific electronic slot machine registers with the machine using their assigned rewards token element, and for financial interactions such as cashing in credits or exchanging credits, a passcode element assigned to the player. As long as the player has the token element and, for financial interactions the correct passcode element, or correct singular credential like a biometric input such as a fingerprint, the electronic slot machine and the control system interfaced with the slot machine consider the player to be verified and start tracking game play and otherwise interacting with the player.

In one known implementation, each electronic slot machine is provided with for example a card reader, a key pad, and a basic LED display. The player inserts their card into the card reader. This verifies the player, and registers the player with that specific machine and allows the casino to track the amount of game play of the player. If the player wishes to cash in credits or exchange credits, the player may also need to enter their passcode using the key pad. Basic messages such as greetings to the player, promotional offers, incentives, advertisements and the like can be presented to the player via the LED display. The basic LED display limits the amount and quality of the content that can be provided by the casino to the player.

In another known implementation, each electronic slot machine can be provided with a card reader and a touchscreen display that is separate from the screen of the slot machine. The player inserts their card into the card reader and, if necessary, enters their passcode using the touchscreen. The touchscreen is larger than a basic LED display and permits display of more content to the player, such as videos, and permits display of more complex messages to the player such as greetings, promotional offers, incentives, advertisements and the like.

In yet another known implementation, each electronic slot machine can be provided with a card reader and a portion of the slot machine screen functions as a touchscreen (referred to as picture-in-picture) via which the player enters their passcode if necessary. Once the player is verified, the portion of the slot machine screen can then be used to display content to the player, such as videos, or greetings, promotional offers, incentives, advertisements and the like.

SUMMARY

Systems and methods are described herein where an application on an electronic gaming machine player's smart device is used to facilitate interactions between the player, an electronic gaming machine being played by the player, and a control system that is interfaced with both the electronic gaming machine and the player's smart device. As described further below, the player registers with a particular electronic gaming machine in any suitable manner, for example using an assigned token and optional passcode. In addition, the player registers with the control system using an application residing on the player's smart device which establishes the player's identity and physical location as being within the venue containing the electronic gaming machine and/or near the electronic gaming machine. The systems and methods described herein eliminate the need to purchase and install expensive touchscreens, picture-in-picture technology, LED displays, key pads and the like on the electronic gaming machines by allowing the control system to communicate with the player's smart device which can be used to interact with the game player in place of, or as a supplement to, the traditional touchscreens, picture-in-picture technology, LED displays, and key pads currently used to interact with players of electronic gaming machines.

The electronic gaming machines can be located in casinos, racinos, gaming establishments, entertainment facilities, and other venues that permit players to play electronic gaming machines. The systems and methods described herein can be used with any type of electronic gaming machine where the dual registration of the player can take place. Examples of electronic gaming machines include, but are not limited to, electronic slot machines, video poker machines, video roulette machines, electronic bingo machines, electronic promotional games, electronic prize wheels, or the like. The electronic gaming machines may also be referred to as electronic casino games, casino games, electronic game machines, electronic games, and the like. However, in some embodiments, the systems and methods described herein can be used with non-electronic games including table games such as, but not limited to, blackjack or roulette.

Traditional game play can take place with or without the dual registration described herein (i.e. the player registers with the electronic gaming machine and also registers with the control system via the player's smart device) occurring. For example, the player can register with the electronic gaming machine as is conventional and play the electronic gaming machine. However, once the dual registration described herein (i.e. the player registers with the electronic gaming machine and also registers with the control system via the player's smart device) takes place, the player can then use their smart device, via the application software, to interact with the control system and the control system can interact with the player via the player's smart device. In one embodiment, one or more inputs provided by the player via the application software on their smart device results in the control system modifying operation of the electronic gaming machine, for example by changing a display screen of the electronic gaming machine such as engaging in a transaction that results in incrementing or decrementing the amount of the credits being displayed.

A termination in any one of the dual registrations can terminate some or all of the interactions described herein. For example, if the electronic gaming machine is not able to continue reading the player's assigned token, the player's registration with the electronic gaming machine terminates, and the player can no longer enter any commands into their smart device that would impact operation of the electronic gaming machine even though the player may still be able to use the application software on their smart device to interact with the control system in a manner that does not impact operation of the electronic gaming machine. Alternatively, if the player logs out of the application software on their smart device, the player can no longer enter any commands into their smart device that would impact operation of the electronic gaming machine, even though the player may continue to play the electronic gaming machine.

Many interactions are possible. For example, the player can use their smart device to: request that some or all of a stored monetary value be credited to the electronic gaming machine being played; cash out their credits or add their credits to an account; claim a casino free play offer; download promotional play to the game; check reward program points and account balance; order food or beverage services; reserve a hotel room; make dinner reservations; order tickets to a show or a movie; order a movie; and many other interactions including those that are currently available to game players using the known technologies described above. In addition, the control system can interact with the player, via the player's smart device, by for example: offering any one of these interactions; sending content to the player such as promotional offers, advertisements, incentives and reward offers; and many other content interactions including those that are currently presented to game players using the known technologies described above. The content provided to the player's smart device can take the form of, for example, text, video, audio, a neural download via an implant in the player, and combinations thereof. In another embodiment, the player may also be able to transmit an item from their smart device to the control system which is relayed to the electronic gaming machine for display on the electronic gaming machine. For example, the player can transmit a "selfie" photograph of a jackpot won by the player from their smart device to the control system, which then transmits the photograph to the electronic gaming machine where the photograph is displayed on the electronic gaming machine. In another embodiment, the player may be able to transmit a signal from their smart device to the control system, which results in changing a graphic or other visual display on the electronic gaming machine such as changing a graphical indication of a casino rewards program level of the player.

The smart device can be any device that is carried or worn by the player, on which application software can be loaded, that includes a display of some form that allows the player to view data, and that allows the player to interact with selection inputs. Examples of smart devices on which the concepts described herein can be implemented include, but are not limited to, smartphones (such as the Apple iPhone™ or Samsung Galaxy™), tablets (such as the Apple iPad™ or Samsung Galaxy Tab™), and phablets (such as the Google Pixel XL™ or the Huawei Mate 9™); wearable devices such as, but not limited to, smartwatches (such as the Apple Watch Series 2™), glasses (such as Google Glass) and other wearable technology; and notebook readers such as the Amazon Kindle™. A smart device as used herein also includes devices implanted in the player that permit the player to cognitively recognize data without a physical display screen, such as a neural connected implant that permits the player to "see" data sent by the control system in the players head, rather than using a physical display screen, such as the technology proposed by Neuralink of California.

The systems and methods described herein are not limited to electronic gaming machines and can be used with other types of electronic machines where a person wishes to interact with the electronic machine in person and the electronic machine interacts with a remote control system, and where dual registration (i.e. between the person and the machine, and also between the person and the control system via the person's smart device) needs to take place before the control system will modify operation of the electronic machine via the control system based on input provided by the person through application software on their smart device. Examples of possible other electronic machines that a person can interact with using the concepts described herein include, but are not limited to, gas pumps and laundry mat washers and driers.

In one embodiment, a method described herein includes establishing a player's first physical presence at an electronic gaming machine by using a token reader of the electronic gaming machine to read a token of the player. The method also includes establishing the player's second physical presence within a venue containing the electronic gaming machine using a smart device of the player. In addition, while both the first physical presence and the second physical presence are established, permitting a control command to be sent from the smart device that controls an operation of the electronic gaming machine. As noted above, if any one of the registrations is terminated, the ability of the player to control an operation of the electronic gaming machine is also terminated.

In another embodiment, a method described herein includes establishing a player's first physical presence at an electronic gaming machine by using a token reader of the electronic gaming machine to read a token of the player. The method also includes displaying at least one selectable control input on the electronic gaming machine when the first physical presence is established, where the at least one selectable control input controls operation of the electronic gaming machine when the at least one selectable control input is selected. In addition, the player's second physical presence within a venue containing the electronic gaming machine is also established using a smart device of the player. Further, while both the first physical presence and the second physical presence are established, displaying at least one selectable control input on the player's smart device, where the at least one selectable control input displayed on the player's smart device controls, when selected, operation of the electronic gaming machine. As noted above, if any one of the registrations is terminated, the ability of the player to control an operation of the electronic gaming machine is also terminated.

In another embodiment, a system described herein includes an electronic gaming machine having a token reader that can read a token assigned to a player, and a display that can display at least one selectable control input to the player when the player registers with the electronic gaming machine using the token reader. A control system is in communication with the electronic gaming machine and controls the operation thereof, the control system permitting the player to register with the control system via a smart device of the player. Application software that is downloadable onto the smart device of the player permits the player to communicate with the control system via the player's smart device to achieve the registration with the control system. When the player registers with the electronic gaming machine and registers with the control system and while the registration is maintained, the control system sends data to the player's smart device causing, via the application software, the player's smart device to display at least one selectable control input, and when the at least one selectable control input displayed on the player's smart device is selected a control signal is received by the control system from the player's smart device with the control signal causing a control command to be sent from the control system to the electronic gaming machine to change an operation of the electronic gaming machine. As noted above, if any one of the registrations is terminated, the ability of the player to control an operation of the electronic gaming machine is also terminated.

DRAWINGS

DETAILED DESCRIPTION

Figure 1:
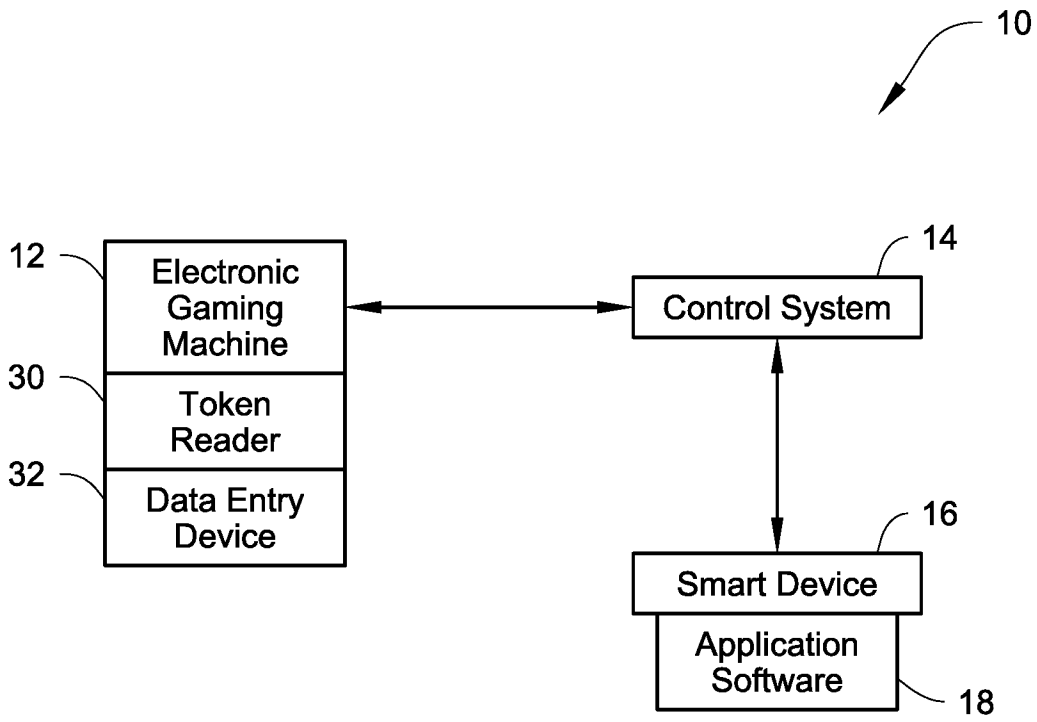
FIG. 1 illustrates one embodiment of a system described herein as applied to an electronic gaming machine.

The following is a description of systems and methods employed with an electronic machine where a person wishes to interact with the electronic machine in person and where the electronic machine interacts with a remote control system. Dual registration (i.e. between the person and the machine, and also between the person and the control system via the person's smart device) takes place. Once the dual registration is established, the control system can provide content to the person's smart device (although as described further below, the control system can provide content to the person's smart device as long as the smart device is registered with the control system). In addition, with dual registration, the person is able to interact directly with the control system and interact indirectly with the electronic machine in a manner whereby the person is able to modify operation of the electronic machine via the control system based on input provided by the person through an application on their smart device.

As used throughout the description and claims, the terms "person" and "user" may be used interchangeably to refer to the individual who wishes to use their smart device to interact with the electronic machine and/or interact with the control system. The term "player" refers to a specific example of an individual playing an electronic gaming machine, casino game, or other gaming device.

As used throughout the description and claims, the term electronic gaming machine includes, but is not limited to, electronic slot machines, video poker machines, video roulette machines, electronic bingo machines, electronic promotional games, electronic prize wheels, or the like. The electronic gaming machines may also be referred to as electronic casino games, casino games, electronic game machines, electronic games, and the like. In some embodiments, the systems and methods described herein can be used with non-electronic games including table games such as, but not limited to, blackjack or roulette.

The electronic gaming machines and non-electronic games can be located in any venue or facility referred to by a variety of names including a casino, racino, a gaming establishment, an entertainment center, and like facilities and venues. The term "casino" as used throughout the description and claims is intended to include and encompass all of these facilities and venues. In addition, as used throughout the description and claims, the term "casino game" or the like is intended to include and encompass an electronic gaming machine and like machines, as well as non-electronic games.

To help in explaining the systems and methods herein, a specific example will hereinafter be described with respect to FIGS. 1-6 where the systems and methods are used in a casino environment and the electronic machine is an electronic gaming machine such as an electronic slot machine, video poker machine, video roulette machine and the like, being played by a guest of the casino (referred to herein as a player or game player). However, the concepts described herein can be used in other casino applications where a casino may want to interface with the player, including table games such as blackjack or roulette; promotional electronic casino games and the like; non-electronic promotional games such as prize wheels and the like; and others. In addition, the concepts described herein can be used in non-casino environments and with electronic machines other than electronic gaming machines as described below with respect to FIGS. 7-10.

Referring initially to FIG. 1, a system 10 is illustrated. The system 10 includes an electronic gaming machine (EGM) 12 and a control system 14. The system 10 may or may not also be considered as including a player's smart device 16 on which application software 18 (referred to hereinafter as application 18) resides. The EGM 12 and the control system 14 are in two-way wired or wireless electronic communications with one another. In addition, the control system 14 and the smart device 16 are in two-way wireless electronic communications with one another via the application 18 and the communication capabilities of the smart device 16. In some embodiments, the EGM 12 and the smart device 16 are not in direct communication with one another although they can be considered in indirect communication with one another via the control system 14. In other embodiments, it is contemplated that the smart device 16 and the EGM 12 can be in direct communication with one another for example when the smart device 16 acts as a token when registering the player with the EGM 12 as described further below.

The application 18 on the smart device 16 is used to facilitate interactions between the player, the EGM 12 being played by the player, and the control system 14. As discussed further below, the player registers with the EGM 12 using a suitable token as discussed further below so that the control system 14 knows that the player is physically present at that EGM 12 (i.e. the player's first physical presence is established at the EGM 12). In addition to the token, establishment of the physical presence of the player at the EGM 12 may also require that the player enter a PIN, passcode, or other unique identifier assigned to the player into the EGM 12. In addition, the player registers with the control system 14 using the application 18 on the smart device 16 which establishes the player's identity and physical location as being within the casino and/or near the EGM 12 (i.e. the player's second physical presence is established). The player registering with the EGM 12 and also registering with the control system 14 via the player's smart device 14 is referred to herein as dual registration.

Traditional game play on the EGM 12 can take place with or without dual registration occurring. For example, the player can register with the EGM 12 as is conventional and play the EGM 12. However, once dual registration described herein takes place, the player can then use their smart device 16, via the application 18, to interact with the control system 14 and the control system 14 can interact with the player via the player's smart device 16. In one embodiment, one or more inputs provided by the player via the application 18 on their smart device 16 results in the control system 14 modifying operation of the EGM 12.

Many interactions are possible. For example, the player can use the smart device 16 with the installed application 18 to: request that some or all of a stored monetary value be credited to the EGM 12; while playing the EGM 12, cash out their credits or add their credits to an account; claim a casino free play offer; download promotional play to the EGM 12; display a photograph from the smart device on the EGM 12; change a graphic or other visual display on the EGM 12 such as changing a graphical indication of a casino rewards program level of the player; check reward program points and account balance; order food or beverage services; reserve a hotel room; make dinner reservations; order tickets to a show or a movie; order a movie; and many other interactions including those that are currently available to game players using the known technologies described above. In addition, the control system 14 can interact with the player, via the player's smart device 16, by for example: offering any one of these interactions; sending content for display on the player's smart device 16 such as promotional offers, advertisements, incentives and reward offers; and many other content interactions including those that are currently presented to game players using the known technologies described above. The content provided to the player's smart device 16 can take the form of, for example, text, video, audio, and combinations thereof.

One non-limiting example of an interaction that changes the operation of the EGM 12 is that the player can send a request to the control system 14 using the application 18 on the smart device 16 that some or all of a stored monetary value, for example in an account managed by the casino, be credited to the EGM 12 being played. If approved, the control system 14 can then send a signal to the EGM 12 to credit the amount requested to the EGM 12. The signal causes the EGM 12 to change the available credits that are displayed on the EGM 12.

Figure 2:
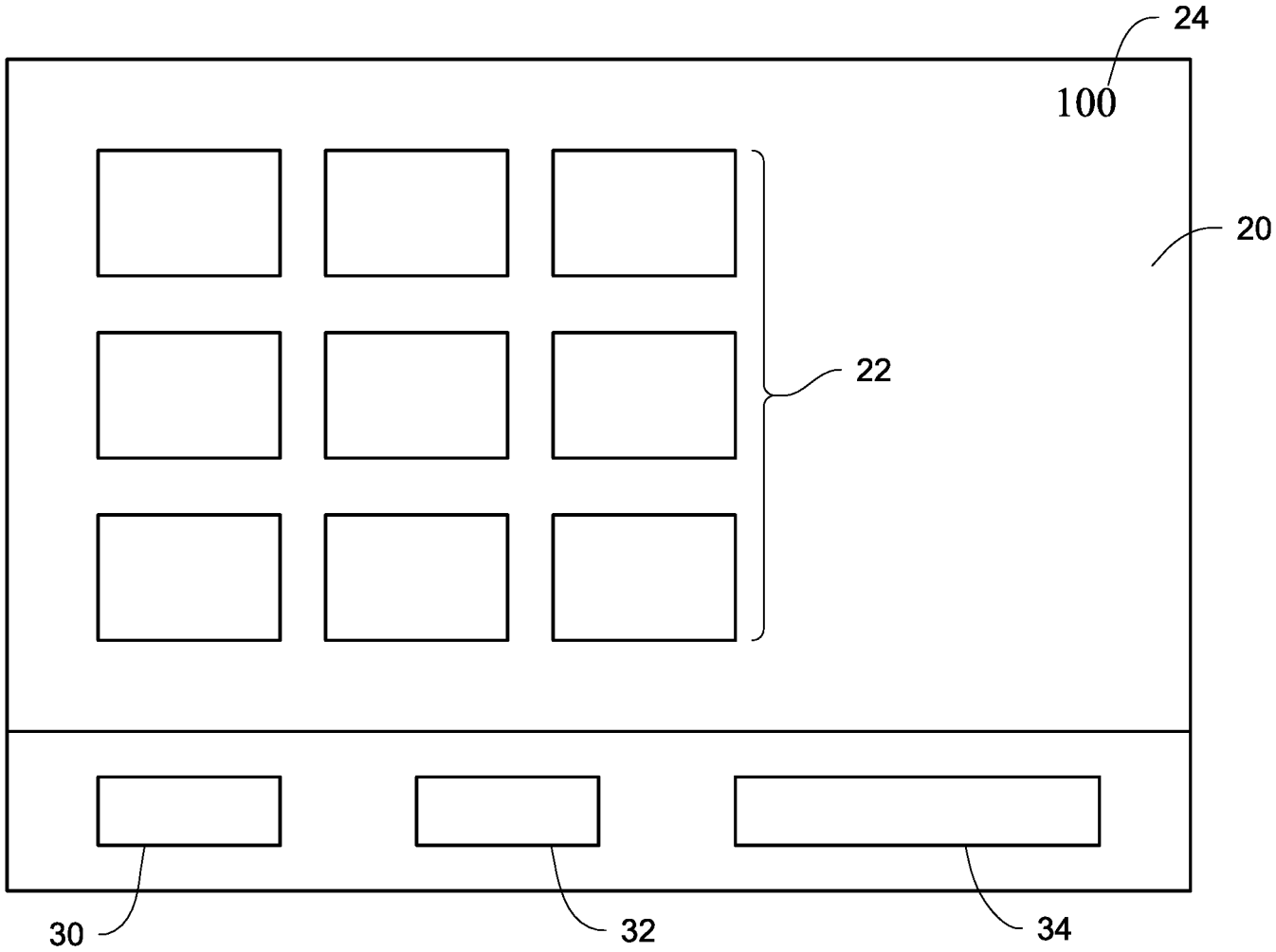
FIG. 2 is a schematic depiction of an example electronic gaming machine with a game screen.

Referring to FIGS. 1 and 2, the EGM 12 is illustrated in this example as being an electronic slot machine. The EGM 12 can be located in a casino or in other locations that permit gambling. The construction and operation of the electronic slot machine is conventional including a display screen 20 that displays the reels 22 of the game, and a section 24 on the screen 20 that displays the number of credits available and/or a monetary value. The electronic slot machine would also include various conventional "buttons" (not illustrated) for selecting the amount to be wagered, initiating spinning of the reels 22, cashing out, and the like. The various "buttons" can be mechanical buttons disposed on the machine, or virtual buttons displayed on the display screen 20 (for example in a picture-in-picture display) which functions as a touchscreen.

The EGM 12 also includes a token reader 30 that reads a token that is issued to a player that signs up for a casino rewards program. In conventional casino rewards programs, the token is typically a plastic card that bears a magnetic stripe on which data is stored that is specific to the player such as a unique identification code assigned to the player, and the token reader 30 is a magnetic stripe card reader that can read the data on the magnetic stripe. However, other forms of tokens and token readers can be used. For example, the assigned token can include a card or other token element with a contact or contactless integrated circuit chip and the token reader 30 can read the chip, the token reader 30 can be a biometric reader that reads the player's fingerprint, performs an iris scan, or performs facial recognition with the read data being compared to biometric data of the player previously stored, or the token reader 30 can be a near field radio frequency device that performs near field reading of a player token such as an assigned token element or reading of the player's smart device 16 which functions as the token.

The EGM 12 can also be provided with an optional data entry device 32 that permits entry of data by the player. The data entry device 32 can take any form that permits entry of data by the player into the EGM 12. In one embodiment, the data entry device 32 can be a dedicated mechanical alphanumeric keypad mounted on the EGM 12. In another embodiment, the data entry device 32 can be part of a touchscreen display 34 mounted on the EGM 12 where the data entry device 32 takes the form of virtual buttons on the touchscreen display 34. In still another embodiment, the data entry device 32 can be part of the display screen 20 of the EGM 12 where the data entry device 32 takes the form of virtual buttons displayed on the display screen 20 (such as in a picture-in-picture display). In another embodiment, data entry by the player could take place using the player's smart device 16 which is in direct communication with the EGM 12 or where the player uses the smart device 16 to inform the control system 14 which EGM 12 the player intends to play, thereby eliminating the need for the data entry device 32. In another embodiment the nature of the token is such that the token is uniquely identified with the player such that no other input beyond the token is required to validate the identity of the player with the EGM 12, thereby eliminating the need for the player to enter a passcode in addition to reading the token, thereby eliminating the need for the data entry device 32. For example, the token can be in the nature of a biometric input that is unique for every player such as a fingerprint, an iris scan, or facial recognition. In another embodiment, the data entry device 32 can be a device that is separate from the EGM 12, for example the data entry device 32 could be a device that is mounted adjacent to but is mechanically separate from, the EGM 12.

The token reader 30 and the optional data entry device 32 permit registration of the player with the EGM 12. A player that is part of the casino rewards program that wishes to have his game play tracked selects the EGM 12 he wishes to play. The player then uses the token reader 30 to read their assigned token, for example by inserting an assigned magnetic stripe card into a magnetic stripe card reader. In addition, in some embodiments where financial transactions may occur or where more secure recognition of the player may be desired, the player may also be required to enter their assigned passcode using the data entry device 32. Information derived from the assigned token and if included the entered passcode are transmitted to the control system 14 which verifies that the data matches data on record. Assuming there is a match, the control system 14 can then keep track of the player's game play on the EGM 12.

The use of assigned tokens, token readers, passcodes and data entry devices to register players with specific EGMs is conventional and well known in the art.

The control system 14 is of generally conventional construction and operation except for its interactions with the smart device 16. The control system 14 is typically controlled and operated by the casino or other entity that controls operation of the EGM 12. However, the control system 14 and the EGM 12 may be owned by separate entities. Many examples of control systems 14 that can be used are known in the art. One example of a suitable control system that can be used is the CasinoTrac™ casino management system available from Table Trac of Minnetonka, Minn. The control system 14 can be located in the same facility as the EGM 12, or the control system 14 can be located in a facility that is separate and remote from the EGM 12.

One function of the control system 14 is to track gaming play of the player on the EGM 12 as part of the casino rewards program, and maintain an ongoing, live updating of the player's rewards program account based on the player's game play. In addition, if the player has funds in the account, the control system 14 can credit some or all of the funds to the EGM 12 based on a request submitted by the player. In addition, the control system 14 can credit remaining or accumulated credits or winnings from the EGM 12 to the player's account. The control system 14 can also transmit content, such as promotional offers, advertisements, incentives and reward offers, to the EGM 12 and/or to the smart device 16.

Figure 3:
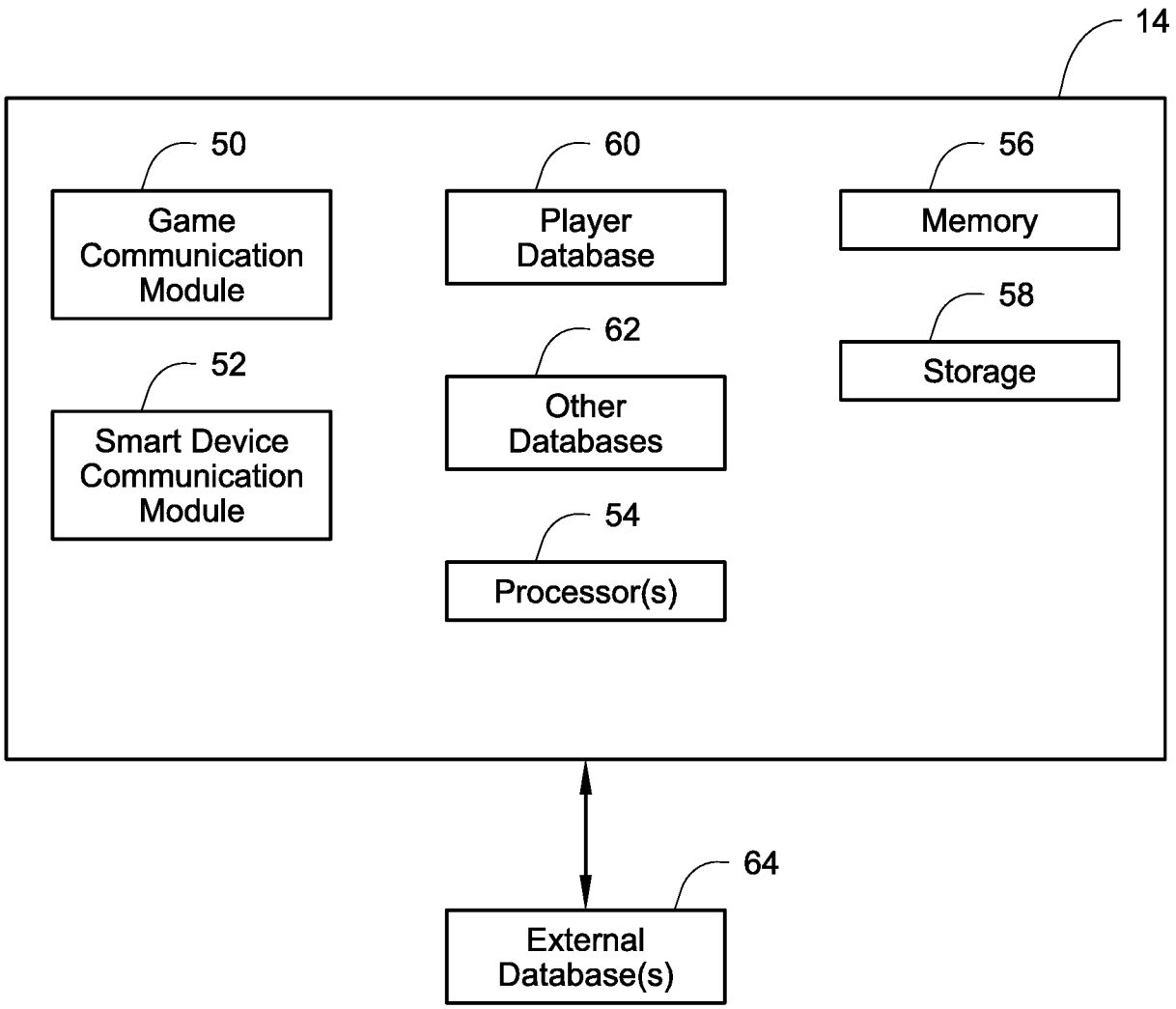
FIG. 3 illustrates an example of a control system that is part of the system of FIG. 1.

Referring to FIGS. 1 and 3, the control system 14 can include elements or be in communication with elements that are suitable for performing the functions of the control system 14 described herein. For example, the control system 14 can include, but is not limited to, a game communication module or means 50 for communications with the EGM 12, a smart device communication module or means 52 for communications with the smart device 16, one or more processors 54 or a single processor having multiple processing cores, memory 56 and/or storage 58, a player database 60 containing information on the players in the casino rewards program, and one or more other databases 62. The control system 14 may also be in communication with one or more external databases 64. The processor 54 can be a single processor, multiple processors, or a single processor having multiple processing cores. The processor 54 can be a single-threaded processor or a multi-threaded processor.

The memory 56 is generally representative of a random access memory such as, but not limited to, Static Random Access Memory (SRAM), Dynamic Random Access Memory (DRAM), or Flash. In some embodiments, at least a portion of the memory can be virtual memory. The storage 58 is generally representative of a non-volatile memory such as, but not limited to, a hard disk drive, a solid state device, removable memory cards, optical storage, flash memory devices, network attached storage (NAS), or connections to storage area network (SAN) devices, or other similar devices that may store non-volatile data. In some embodiments, the storage 58 can include storage that is external to the control system 14, such as in cloud storage.

The smart device 16 is owned by the player. The smart device 16 can be any device that is carried or worn by the player, on which the application software 18 can be loaded, that includes a display of some form that allows the player to view data on the display of the smart device 16, and that includes a data input of some form that allows the player to enter selection inputs and/or data. Examples of smart devices on which the concepts described herein can be implemented include, but are not limited to, smartphones (such as the Apple iPhone™ or Samsung Galaxy™), tablets (such as the Apple iPad™ or Samsung Galaxy Tab™), and phablets (such as the Google Pixel XL™ or the Huawei Mate 9™); wearable devices such as, but not limited to, smartwatches (such as the Apple Watch Series 2™), glasses (such as Google Glass™) and other wearable technology; and notebook readers such as the Amazon Kindle™. A smart device as used herein may also include devices implanted in the player that permit the player to cognitively recognize data without a physical display screen, such as a neural connected implant that permits the player to "see" data sent by the control system in the player's head, rather than using a physical display screen, such as the technology proposed by Neuralink of California.

Figure 4:
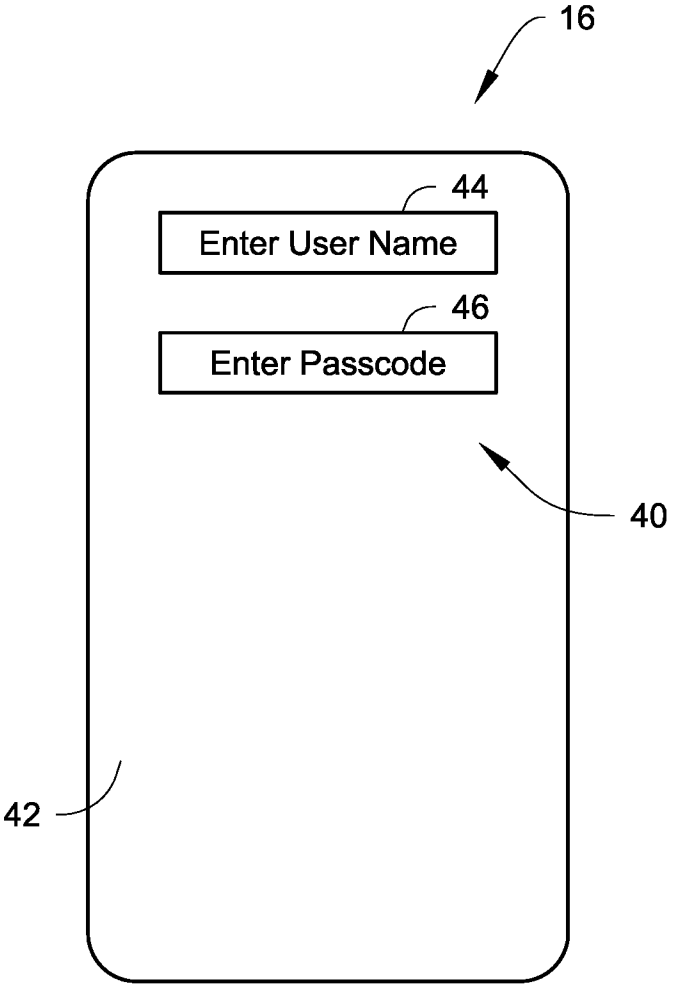
FIG. 4 is a schematic depiction of the display screen of a player's smart device displaying an example of the user interface of the application software described herein.

The player uses his smart device 16 to register with the control system 14 via the application 18. Referring to FIGS. 1, 3 and 4, the application 18 allows the player to login or register with the control system 14 via an initial login screen 40 displayed on a display 42 of the smart device 16. In the illustrated example, the login can include a conventional login such as user name 44 and a passcode 46 which may or may not match the passcode (if used) the player enters into the EGM 12. In other embodiments, the login can be more complex such as incorporating biometric data such as fingerprint, iris scanning, or facial recognition. Once entered, the login information is transmitted to the control system 14 to verify a match between the login data with data on record for example in the player database 60. In some embodiments, the application software 18 can have a unique identifier associated therewith that is transmitted to the control system 14, for example with the login information.

In addition to verifying login data, the control system 14 also verifies the physical location of the player. In some embodiments, the control system 14 may need to verify that the player is relatively physically close to the EGM 12. In other embodiments, the control system 14 may need to verify that the player is somewhere within the casino or other area where the EGM 12 is located but not necessarily in close proximity to the EGM 12. The control system 14 can use any suitable technology and technique for verifying the physical location of the player. For example, in one embodiment the smart device 16 must connect to wifi (public or non-public) offered by the casino in order to connect to the control system 14. By the smart device 16 connecting to the casino wifi, the control system 14 knows that the smart device 16, and therefore the player, are in sufficient proximity to the EGM 12 to verify the physical location of the player. When more precise physical location verification is desired, the control system 14 can verify physical location of the player by requiring entry of a PIN, passcode or other unique identifier assigned to the player via the data entry device on the EGM 12 in combination with the reading of the player's assigned token by the token reader 30 at the EGM 12, or by using GPS tracking of the smart device 16.

Assuming there is a confirmation of the login data, and verification of the physical location of the smart device 16, the control system 14 can then interact with the player via the player's smart device 16 including sending content to the smart device 16 and receiving commands from the player's smart device 16.

Once the dual registration takes place, the system 10 is fully operational and interactions can take place between the control system 14 and the smart device 16, and indirectly between the smart device 16 and the EGM 12. The player can use their smart device 16 and the application 18 to indirectly modify the operation of the EGM 12, for example by changing the displayed credits 24 or other operation modifications described herein.

Figure 5:
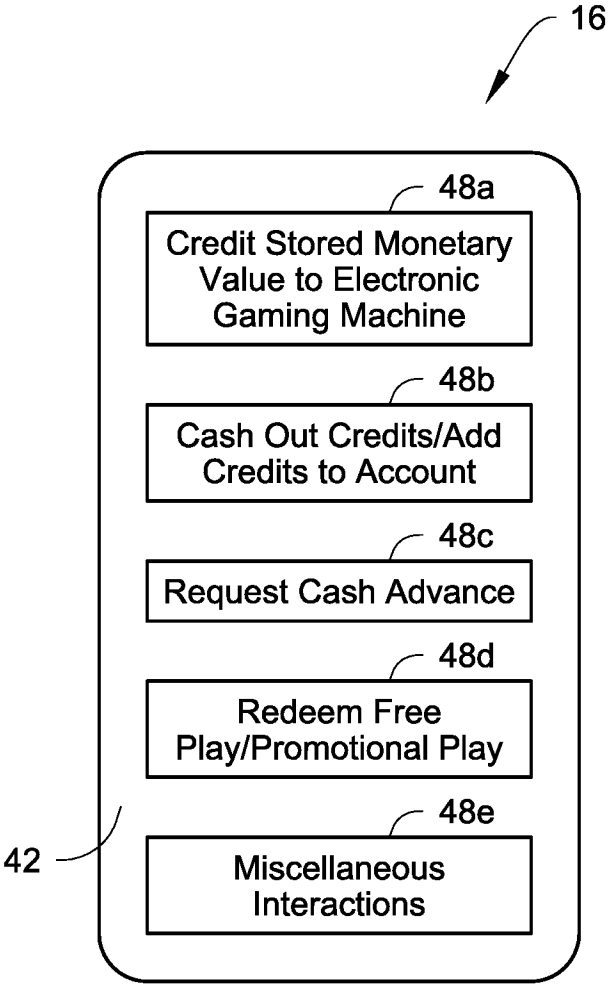
FIG. 5 is a schematic depiction of the display screen of a player's smart device displaying another example of the user interface of the application software described herein as applied to an electronic gaming machine.

For example, FIG. 5 illustrates an example of a user interface provided by the application software on the display screen 42 of the smart device 16. The user interface may present the player a selectable option 48*a* of requesting that some or all of a stored monetary value in an account of the player kept by the casino be credited to the EGM 12. When the option 48*a* is selected, a request signal is sent to the control system for approval and processing. For example, referring to FIGS. 1-2 together with FIG. 5, the player may have zero credits 24 available at some moment in time but the player may have an account with a stored value equal to 100 credits. The player can use the application software 18 and the selectable option 48*a* to send a request signal to the control system 14 requesting that 100 credits be added to the EGM 12. The control system 14 receives the request signal, processes the request signal, verifies that 100 credits exist in the player's account, and if approved sends a signal to the EGM 12 to add the 100 credits which is then displayed 24, for example on the display screen 20 or on the display 34. The player can then continue game play.

In another embodiment, the user interface may present the player a selectable option 48*b* to cash out from the EGM 12. If the player selects the selectable option 48*b*, a request signal is sent to the control system 14 requesting to cash out his credits from the EGM 12 which, if approved by the control system 14, sends a suitable signal to the EGM 12 to print out a credit ticket which can then be taken to a cashier to be redeemed for cash or used later in an EGM, or the control system 14 can add the credits to the player's account. At the same time, the displayed credits 24 on the EGM 12 are set to zero.

In another embodiment, the user interface may present the player a selectable option 48*c* to request a cash advance from the casino. If the player selects the selectable option 48*c*, a request signal is sent to the control system 14 requesting the cash advance from the casino, which if approved, results in the control system 14 sending a signal to the EGM 12 increasing the displayed available credits 24.

In still another embodiment, the user interface may present the player a selectable option 48*d* to redeem a free play offer or promotional play sent to the player by the control system 14. If the player selects the selectable option 48*d*, a request signal is sent to the control system 14 which in turn sends a signal to the EGM 12 to implement the free play offer or promotional play on the EGM 12.

In some embodiments, the selectable options 48*a*, 48*b*, 48*c*, 48*d* are not presented in the same user interface to the player, but are instead presented to the player on separate user interfaces at different points in time or based on menu selections chosen by the player. In other embodiments, the selectable options 48*a*, 48*b*, 48*c*, 48*d* could be presented to the player in the same user interface.

Miscellaneous interactions 48*e* can take place between the control system 14 and the smart device 16 that do not change the operation of the EGM 12. For example, the player can check reward program points and account balance; order food or beverage services; reserve a hotel room at the casino; make dinner reservations; order tickets to a show or a movie; order a movie; and many other interactions including those that are currently available to game players using the known technologies described above. These interactions can be made available to the player via one or more suitable menus provided by the application 18 and displayed on the smart device 16. In addition, the control system 14 can interact with the player, via the player's smart device 16, by for example: proactively offering any one of these interactions; sending content for display on the player's smart device 16 such as promotional offers, advertisements, incentives and reward offers; sending audio and/or video messages and greetings from or on behalf of casino management thanking the player for their game play; and many other content interactions including those that are currently presented to game players using a display on the EGM 12. The content provided to the player's smart device 16 can take the form of, for example, text, video, audio, and combinations thereof.

A termination in any one of the dual registrations can terminate some or all of the interactions described herein. For example, if the token reader 30 of the EGM 12 is not able to continue reading the player's assigned token, the player's registration with the EGM 12 terminates, and the player can no longer enter any commands into their smart device 16 that would impact operation of the EGM 12. However, the player may still be able to use the application 18 on their smart device 16 to interact with the control system 14 in a manner that does not impact operation of the EGM 12. Alternatively, if the player logs out of the application 18 on their smart device 16, thereby terminating the registration with the control system 14, the player can no longer enter any commands into their smart device 16 that would impact operation of the EGM 12. However, the player may continue to play the EGM 12.

Figure 6:
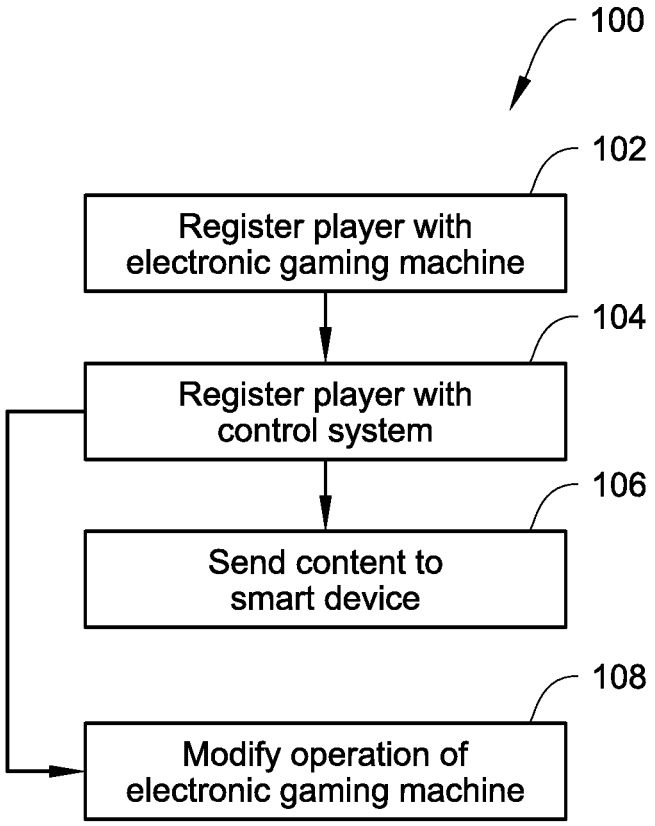
FIG. 6 illustrates steps in a method described herein as applied to an electronic gaming machine.

An example of a method 100 involving the system 10 is illustrated in FIG. 6. Referring to FIG. 6 together with FIG. 1, in the method, in step 102 a player registers with the EGM 12, for example in the manner described above. In step 104, the player registers with the control system 14 using the application 18 on the smart device 16. Steps 102 and 104 can occur in any order. If at least step 104 has taken place, in step 106 the control system 14 interacts with the smart device 16 by sending content to the smart device 16 and receiving various control signals from the smart device 16. If both steps 102 and 104 have occurred, in step 108 some signals from the smart device 16 transmitted to the control system 14 can cause the control system 14 to modify the operation of the EGM 12 in some manner including, but not limited to, changing the available credits that are displayed on the display screen 20 and/or the display 34 of the EGM 12.

As explained above, the concepts involved in the system 10 are not limited to casinos or casino gaming. The concepts can be used with any electronic machine where a person wishes to interact with the electronic machine in person and where the electronic machine interacts with a remote control system. For example, referring to FIGS. 7-10, a system 110 is illustrated where a user's smart device 112 is used to interact with and change the operation of an electronic machine 114 via a server or other controller 116 functioning as a control system. Examples of the electronic machine 114 include the EGMs previously described, gas pumps at a gas station, washers and driers in a laundromat, and other machines. Examples of interactions where the smart device 112 can be used to change the operation of the machine 114 include, but are not limited to, starting and stopping operation of the machine 114; in the case of the machine 114 being a gas pump, controlling operation of the pump; in the case of the machine 114 being a washer or dryer in a laundromat, controlling operation of the washer or dryer.

Figure 8:
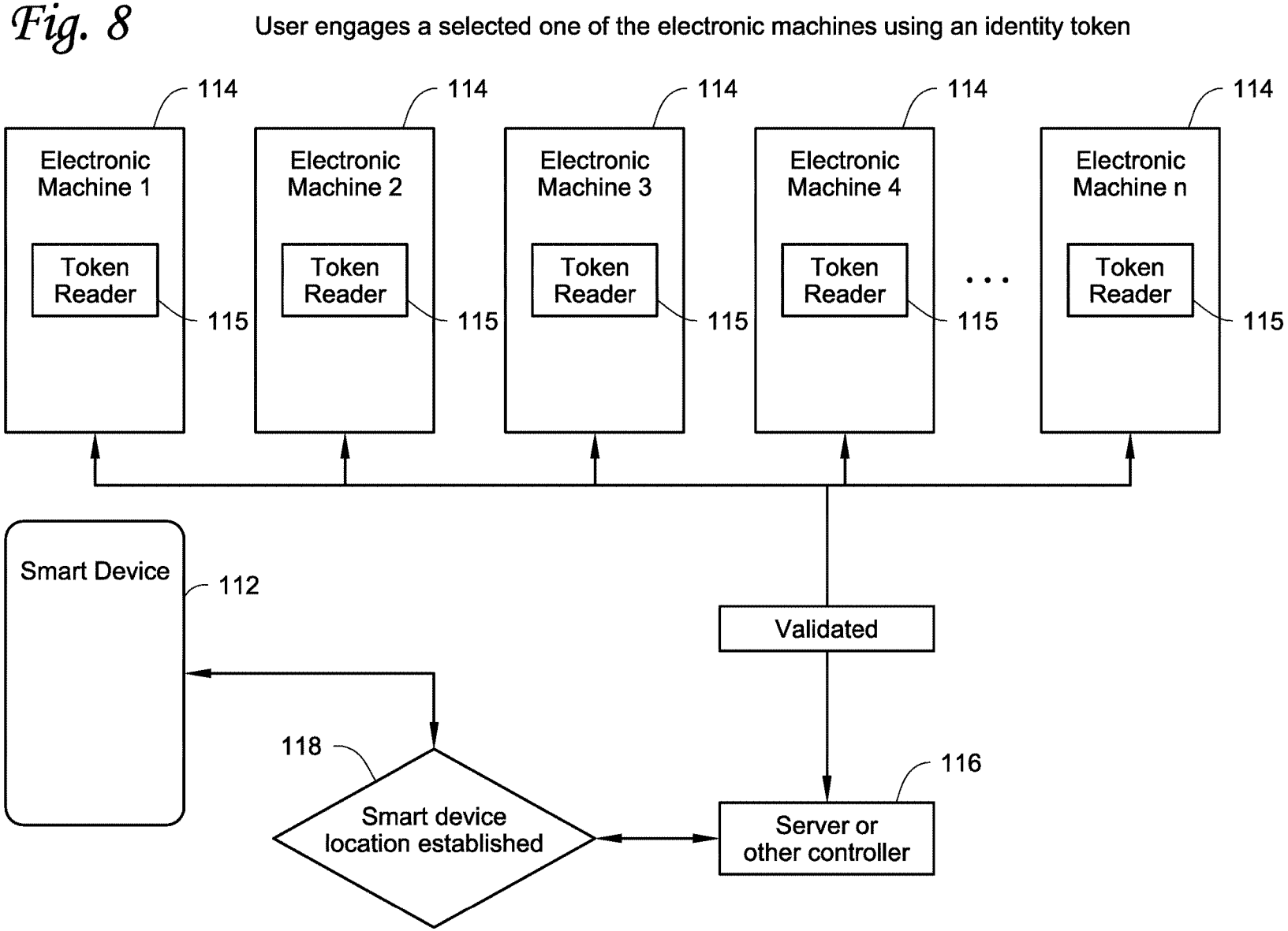
FIG. 8 illustrates an example of how a user of the system of FIG. 7 can engage one of the electronic machines.

Similar to the system 10 describe above, dual registration takes place in the system 110 with the person using their smart device 112 to register with the server 116 and the user registers with the server 116 via the electronic machine 114. In addition, the location of the smart device 112 is established 118 by sending data to the server 116 that permits the server to determine the location of the smart device 112. Referring to FIG. 8, the user selects the desired electronic machine 114 and engages with the machine 114 using an identity token, such as one of the identity tokens described above. A token reader 115 on the selected machine 114 reads the token, with optional input of a separate passcode into the machine 114. The information is transmitted to the server 116 to register the user with that machine 114. In addition, the user registers with the server 116 via the user's smart device 112 using application software on the smart device 112. The user enters suitable login information, such as username and passcode or biometric data as described previously, into a user interface on the smart device 112 which is transmitted to the server 116 along with location information which establishes 118 the geographic location of the smart device 112. Assuming the dual registrations occurs, certain subsequent inputs on the smart device 112 may be used to control operation of the selected electronic machine 114.

Figure 7:
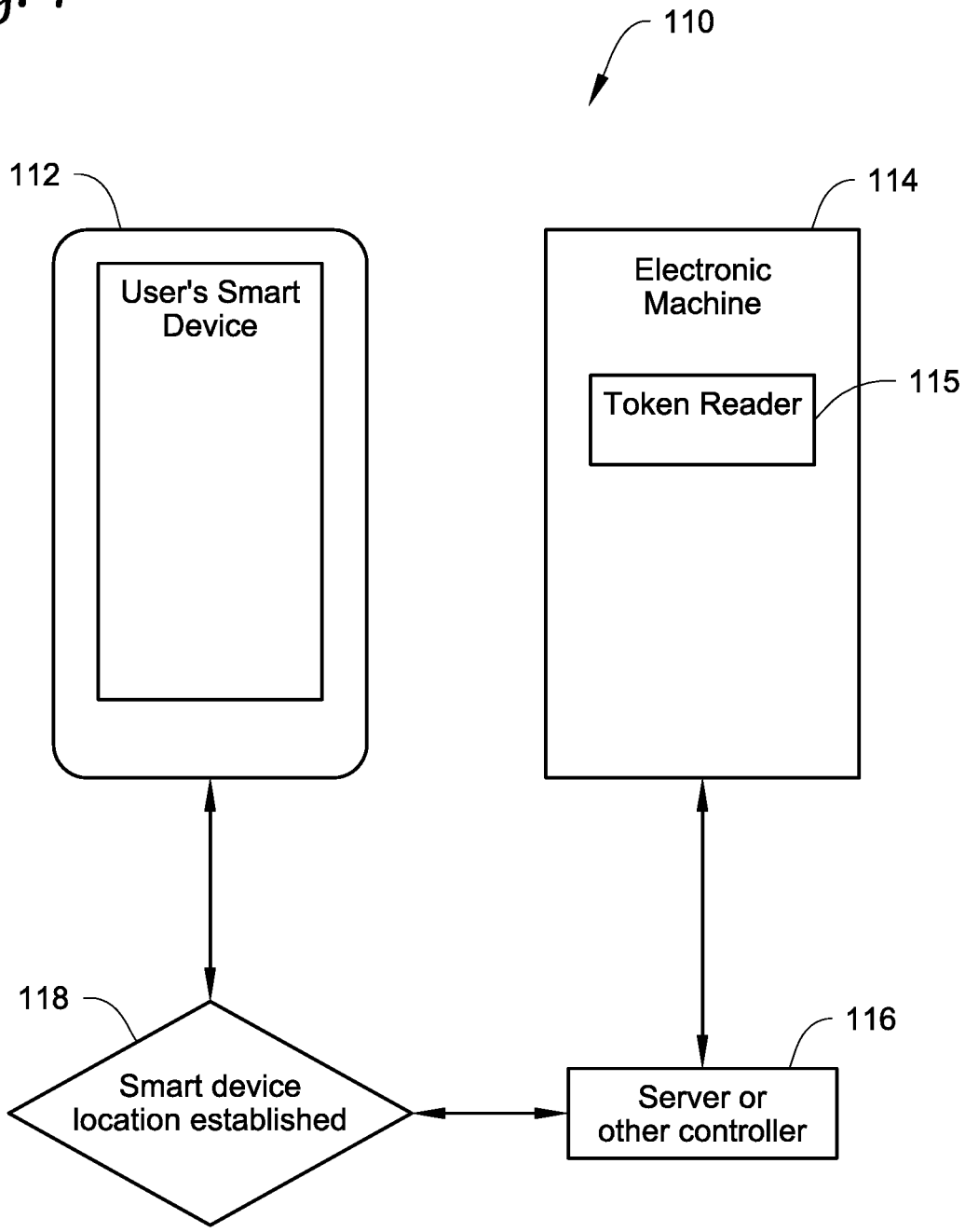
FIG. 7 illustrates another embodiment of a system described herein as applied to an electronic machine.
Figure 9:
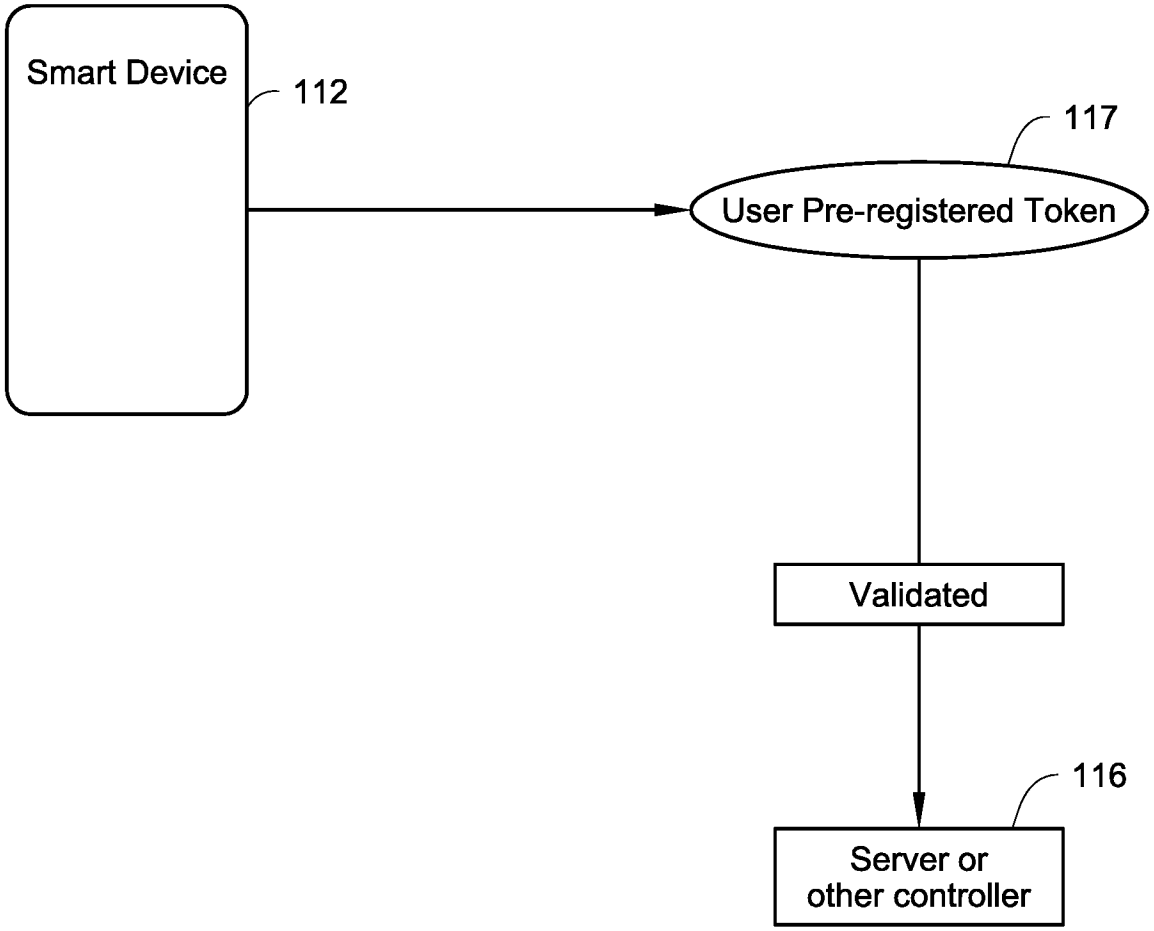
FIG. 9 illustrates an example of how a user of the system of FIG. 7 can achieve login of their smart device to the system.

FIG. 9 illustrates an example of how a user of the system 110 of FIG. 7 can achieve login of their smart device 112 with the server 116 of the system 110. The user can enter login information, such as user name and passcode into a user interface on the smart device 112 which when entered is transmitted to the server 116 for verification. The login information acts as a form of a token 117. Another form of a "token" 117 is biometric data such as fingerprint, iris scanning or facial recognition, where the smart device 112 has the ability to read a fingerprint, conduct an iris scan, or read facial data for later facial recognition, and transmit the data to the server 116 for verification. Alternatively, a pre-registered physical token 117 can be assigned to the user. The physical token can be read by the smart device 112, which transmits data read from the token 117 to the server 116 for verification. The physical token could be, for example, a plastic card with a magnetic stripe or an integrated circuit chip.

Figure 10:
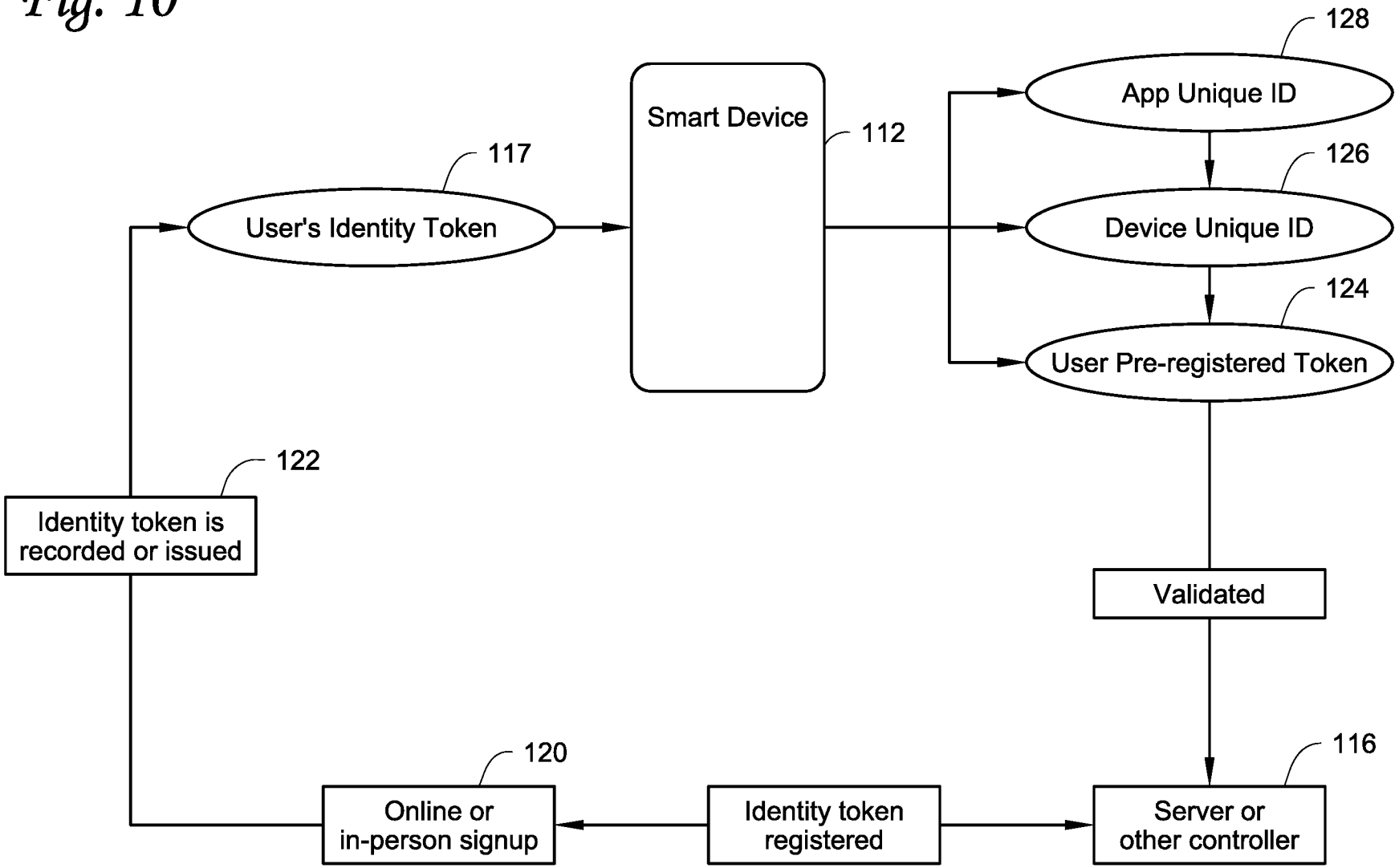
FIG. 10 illustrates an example of how a user of the system of FIG. 7 can register their smart device with the system.

Referring to FIG. 10, the user can sign up 120 for an identity token 117 online via a website or in-person. The identity token of the user is recorded (e.g. in the case of a biometric identify token) or issued to the user (e.g. in the case of a physical identity token) 122 which is subsequently used by the user to register with the server 116. When the identity token 117 is recorded or issued, the identity token information is also sent to the server 116 which stores the information for later validation. When the user wishes to register with the server 116, the smart device 112 send data such as one or all of the pre-registered token data 124, a unique identifier 126 of the smart device 112, and/or a unique identifier 128 of the application software to the server 116 for validation. The unique identifier 126 of the smart device 112 can take any suitable form that uniquely identifies the smart device 112, for example the MAC address or a serial number of the smart device 112. The unique identifier 128 of the application software is assigned to and downloaded with the application software upon installation on the smart device 112.

Figure 11:
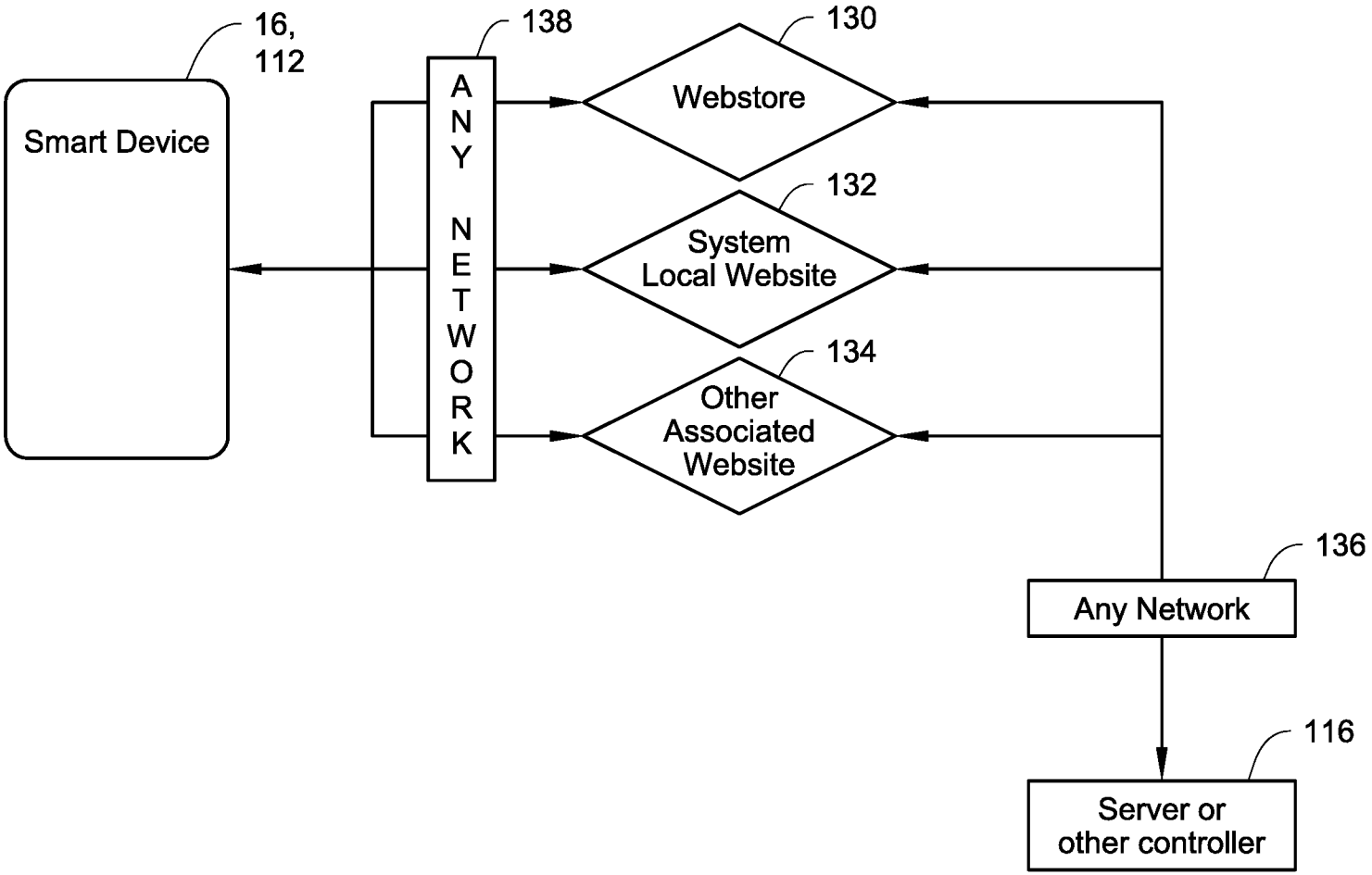
FIG. 11 illustrates an example of how a user of the systems of FIGS. 1 and 7 can obtain the software application for their smart device.

FIG. 11 illustrates an example of how a user of the systems of FIGS. 1 and 7 can obtain the software application for the smart device 16, 112. The application software can be made available to the user from any suitable source, for example from an on-line web/app store 130, a local website or intranet 132 accessed by the casino wifi, or other website 134. The application software can reside on the source 130, 132, 134, or the source 130, 132, 134 can communicate with the server 116 via any suitable network 136 to obtain the application software and provide the application software to the smart device 16, 112 over any suitable network 138.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method comprising:

establishing a player's first physical presence at an electronic gaming machine by using a token reader of the electronic gaming machine to read a token of the player;

establishing the player's second physical presence within a venue containing the electronic gaming machine using a smart device owned by the player, wherein establishing the player's second physical presence within the venue comprises receiving a registration request from the smart device at a control system that is separate from and in communication with both the electronic gaming machine and the smart device;

while both the first physical presence and the second physical presence are established, permitting a control command to be sent from the control system to the electronic gaming machine that controls an operation of the electronic gaming machine based on a control signal initiated at the smart device and received by the control system from the smart device.

2. The method of claim 1, comprising:

displaying on a display of the electronic gaming machine at least one selectable control input when the first physical presence is established, the at least one selectable control input when selected controlling the operation of the electronic gaming machine; and displaying at least one selectable control input on the player's smart device when both the first physical presence and the second physical presence are established, the at least one selectable control input displayed on the player's smart device when selected generating the control signal.

3. The method of claim 1, wherein the electronic gaming machine is an electronic slot machine, video poker machine, video roulette machine, electronic bingo machine, electronic promotional game, or an electronic prize wheel.

4. The method of claim 1, wherein controlling the operation of the electronic gaming machine comprises changing available credits that are displayed on a display of the electronic gaming machine.

5. A method comprising:

establishing a player's first physical presence at an electronic gaming machine by using a token reader of the electronic gaming machine to read a token of the player;

displaying at least one selectable control input on the electronic gaming machine when the first physical presence is established, the at least one selectable control input controlling operation of the electronic gaming machine when the at least one selectable control input is selected;

establishing the player's second physical presence within a venue containing the electronic gaming machine using a smart device owned by the player, wherein establishing the player's second physical presence within the venue comprises receiving a registration request from the smart device at a control system that is separate from and in communication with both the electronic gaming machine and the smart device, the control system being in communication with a monetary account of the player; and while both the first physical presence and the second physical presence are established, permitting a control signal to be received by the control system from the smart device and in response to receiving the control signal the control system transfers funds from the electronic gaming machine to the monetary account and/or the control system transfers funds from the monetary account to the electronic gaming machine.

6. The method of claim 5, wherein the electronic gaming machine is an electronic slot machine, video poker machine, video roulette machine, electronic bingo machine, electronic promotional game, or an electronic prize wheel.

* * * * *